United States Patent [19]

Meiners

[11] 4,006,536

[45] Feb. 8, 1977

[54] CONCURRENT-COUNTERCURRENT FLOW GRAIN DRYER WITH AIR RECYCLING MEANS

[75] Inventor: Elmo R. Meiners, Anchor, Ill.

[73] Assignee: M & W Gear Company, Gibson City, Ill.

[22] Filed: Jan. 22, 1976

[21] Appl. No.: 651,601

[52] U.S. Cl. ..... 34/169; 34/65; 34/170; 34/212; 98/56

[51] Int. Cl.[2] ..... F26B 17/12

[58] Field of Search ..... 34/64, 65, 167, 168, 34/169, 170, 174, 210, 212, 224, 225, 232; 98/32, 33 A, 52, 55, 56

[56] References Cited

UNITED STATES PATENTS

| | | | |
|---|---|---|---|
| 2,207,360 | 7/1940 | Spellacy | 34/169 |
| 2,764,819 | 10/1956 | Hallman | 34/169 |
| 3,112,188 | 11/1963 | Zehnder | 34/169 |
| 3,710,449 | 1/1973 | Rathbun | 34/170 |
| 3,727,323 | 4/1973 | Meiners et al. | 34/170 |
| 3,913,242 | 10/1975 | Fackler | 34/170 |

*Primary Examiner*—Kenneth W. Sprague
*Assistant Examiner*—James C. Yeung
*Attorney, Agent, or Firm*—Allegretti, Newitt, Witcoff & McAndrews

[57] ABSTRACT

An improved concurrent flow, counterflow continuous type grain dryer includes bottom cold air inlet ducts for counterflow of cold air, a first and second set of upper horizontal hot air inlet ducts connected with a common hot air manifold for concurrent flow of hot air, intermediate exhaust ducts transverse to the inlet ducts and connected with the hot air manifold for recycling of exhaust air through the inlet ducts, and separate upper, transverse exhaust ducts vented to the atmosphere.

6 Claims, 3 Drawing Figures

CONCURRENT-COUNTERCURRENT FLOW GRAIN DRYER WITH AIR RECYCLING MEANS

BACKGROUND OF THE INVENTION

This invention relates to an improved continuous grain flow, concurrent-countercurrent type grain dryer.

Grain, particularly corn, is often dried after picking and before storage to prevent wet pockets, mildew and consequent spoilage. Fast, efficient drying may be effected by the introduction of a generally heated, low moisture content drying medium (usually air) to the wet grain. The drying medium is moved relative to the grain and accumulates moisture from the grain. The moist saturated drying medium is then removed from contact with the grain with the result that the grain has a relatively lower moisture content.

Various types of grain dryers have been disclosed by the prior art. For example, Meiners et al in U.S. Pat. No. 3,727,323 discloses a concurrent-countercurrent grain dryer including a preheater means. Grain is introduced to the top of a bin and removed from the bottom in a continuous process. Cold air is introduced through cold air inlets adjacent the bottom of the bin for countercurrent flow. Hot dry air is introduced adjacent the top of the bin for concurrent flow. Both flows are removed at an intermediate position within the bin through exhaust ducts. An additional set of preheater ducts which serve an exhaust function are positioned above the hot air inlet ducts.

While such a grain drying mechanism provides adequate results, additional research and experimentation has shown that the exhaust air discharged from the grain dryer is often not fully moisture laden, nor is the temperature adequately reduced to achieve maximum efficiency by the dryer. To improve the efficiency of moisture and heat transfer between the drying medium (air) and the material being dried (grain), is a desirable objective in a grain drying system. Maintenance of the concurrent-counter current method of drying the grain is also desirable in order to maximize grain condition.

SUMMARY OF THE INVENTION

In a principal aspect, the present invention comprises a grain dryer of the concurrent-countercurrent continuous grain flow type including at least two sets of hot air inlet ducts connected to a single hot air inlet manifold and at least one set of cold air inlet ducts connected to a cold air inlet manifold. Additionally, at least two separate sets of exhaust ducts are included. One of the sets of exhaust ducts is connected to the hot air inlet manifold to provide for recycling of exhaust air, while the other set of exhaust ducts discharge moisture laden air to the atmosphere.

It is thus an object of the present invention to provide an improved continuous grain flow, concurrent-countercurrent grain dryer.

Another object of the present invention is to provide a grain dryer of the concurrent-countercurrent type wherein exhaust air from the dryer is recycled in order to increase efficiency.

Still another object of the present invention is to provide an improved concurrent-countercurrent continuous grain flow dryer of simplified construction.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
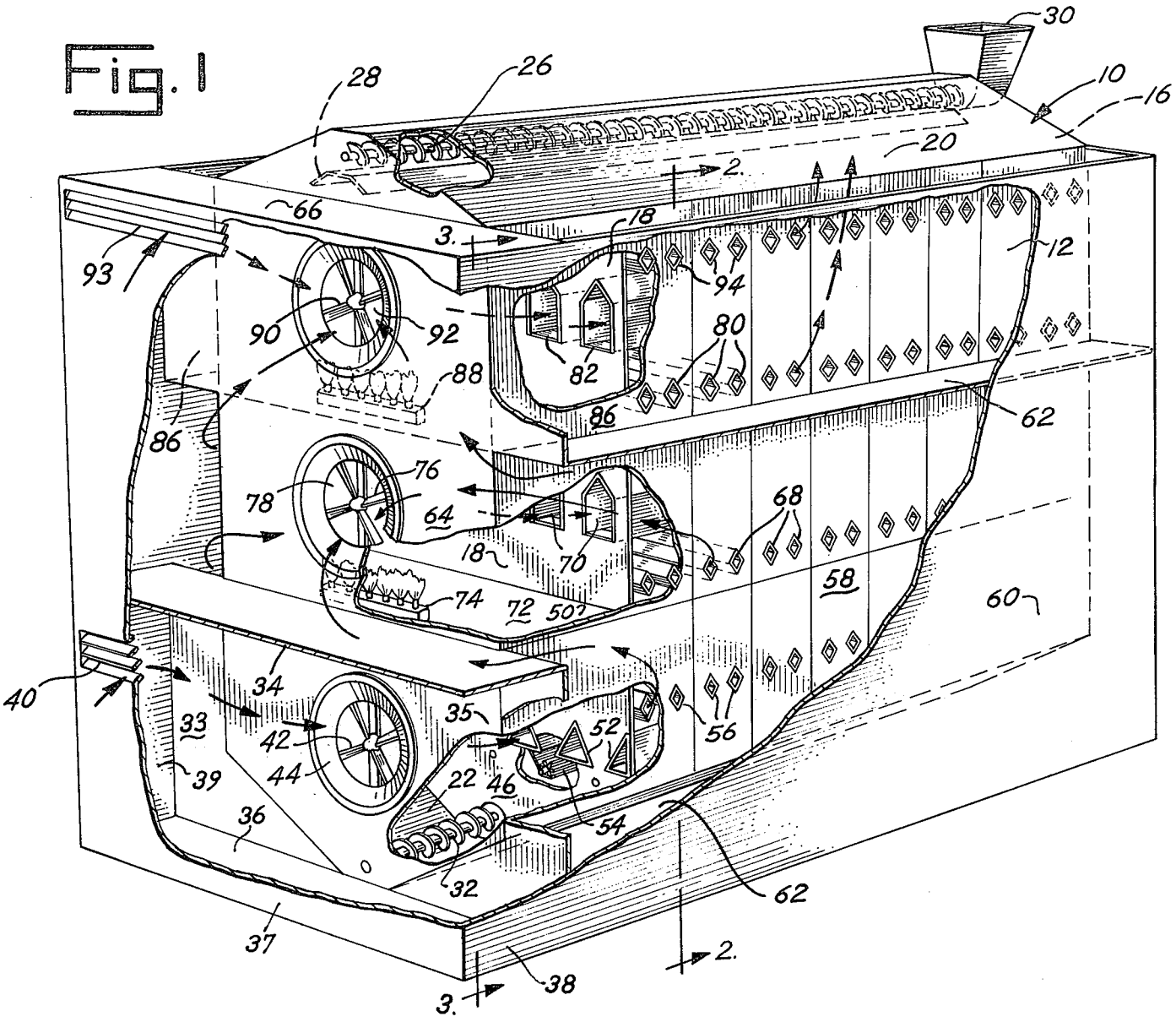
FIG. 1 is a cut-away perspective view of the improved grain dryer of the present invention.
Figure 3:
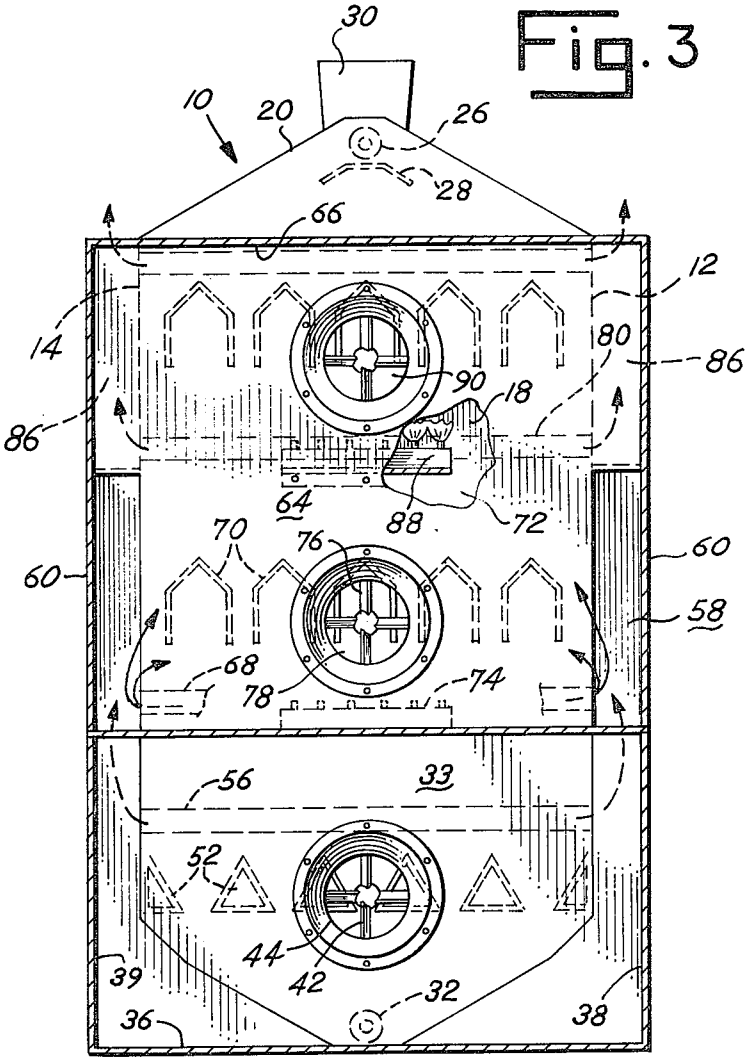
FIG. 3 is a cross-sectional end view taken along the line 3—3 in FIG. 1.
Figure 2:
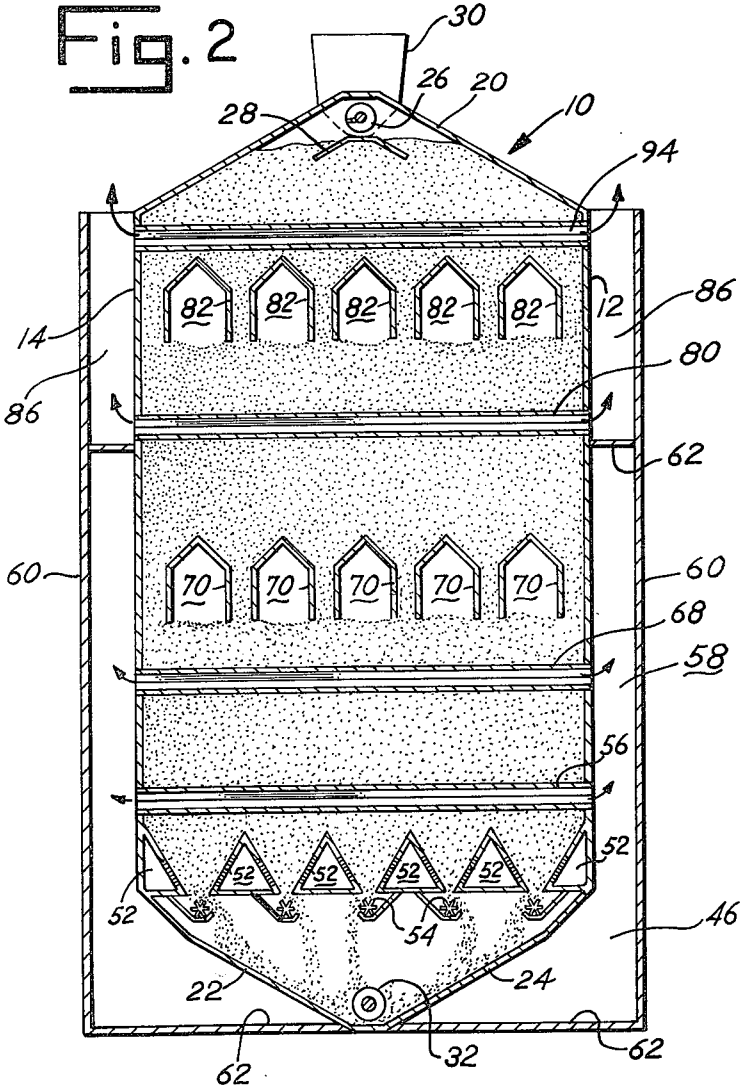
FIG. 2 is a cross-sectional end view of the grain dryer taken through the plenum chambers along the line 2—2 in FIG. 1.

Referring to the figures, like numbers refer to like parts. The grain dryer includes a grain bin 10 which includes opposed side walls 12 and 14, a top wall 20 and inclined bottom walls 22 and 24. A grain feed auger 26 is provided to feed wet grain into the top of the bin 10. A diverting plate 28 spreads the grain over the interior of the bin 10 as it is being fed into the bin 10 by the auger 26. Grain is introduced to the auger feed 26 through a hopper 30 as shown or through auger means, not shown. Grain is continuously introduced into the bin 10. During operation of the bin 10 as a dryer, the bin is substantially filled with grain as it is continuously fed into the top of the bin 10 and withdrawn from the bottom.

The inclined bottom walls 22 and 24 are arranged at substantially the angle of repose of grain fed into the bin 10. A discharge auger 32 continuously removes dried grain from the bin 10. A grain floor construction (described below) is positioned above the auger 32. Thus, grain from the bin 10 passes through the floor construction and flows to the auger 32 for removal.

The grain continuously passes downwardly through the bin 10. Simultaneously, various flows of a drying medium, preferably air, also flow through the bin 10. The general flow of the drying medium and similar dryer constructions have been generally described in various prior art patents, including Meiners, U.S. Pat. No. 3,727,323. The structure of the present invention retains some of the characteristics associated with the prior art and additionally provides for a new combination of air flow in response to a new grain dryer structure. The general concurrent-countercurrent air flow is preserved with the structure of the present invention.

Referring again to the figures, a cold air manifold 33 comprised of manifold walls 34–39 includes a cold air inlet 40. The cold air inlet 40 is, in the construction shown, provided in wall 37. A fan 42 is mounted in wall 35 to draw air through inlet 40 into the cold air manifold 33 and through opening 44 into a cold air plenum 46. Plenum 46 is defined by end wall 18, side walls 12 and 14, bottom walls 22 and 24, a top wall 50 and manifold wall 35.

A plurality of cold air inlet ducts 52 connect with the plenum 46 so that cold air may pass into the inlet ducts 52. The cold air inlet ducts 52 are triangular in cross-section and form part of the grain bin floor in the same manner as disclosed in U.S. Pat. No. 3,727,323, which is incorporated herewith by reference. Thus, the cold air inlet ducts 52 comprise a plurality of horizontal, parallel inlet ducts 52 which are perforated so that cold air can flow from the interior of the ducts 52 to the interior of the bin 10. The ducts 52 are spaced from each other to define parallel openings through which the grain passes subsequent to drying. Rotating metering rolls 54 serve to discharge the grain through these parallel openings onto the bottom wall or floor 22 and 24 of the bin 10 for removal by means of auger 32.

Immediately above and transverse to the cold air inlet ducts 52, are parallel spaced, diamond cross-section exhaust ducts 56. The exhaust ducts 56 are formed from perforated material in the same manner as exhaust ducts disclosed in U.S. Pat. No. 3,727,323. The exhaust ducts 56 terminate at opposite side walls 12 and 14. In combination with side walls 12 and 14, there is provided an exhaust manifold 58 which includes outer wall 60, upper wall 62, extensions of the end walls 16 and a bottom wall 62. The plenum 58 connects with a hot air inlet manifold 64 formed by a vertical extension of wall 35, wall 34, wall 37, side walls 38 and 39 and a top wall 66. Thus, exhaust air from the exhaust ducts 56 passes from plenum 58 into hot air manifold 64.

Positioned above the exhaust ducts 56 and arranged in like fashion is a second set of exhaust ducts 68 which also exit into the exhaust manifold 58. Again, exhaust products through ducts 68 ultimately flow into manifold 64.

Positioned above the exhaust ducts 68 is a first set of hot air inlet ducts 70. The hot air inlet ducts 70 are arranged in parallel with the cold air inlet ducts 52. Ducts 70 have a construction of the type shown in U.S. Pat. No. 3,727,323. As shown in the drawing, the ducts 70 terminate in a plenum 72 which includes its own burner 74 for heating air coming into the plenum 72. A hot air inlet fan 76 moves air from manifold 64 through opening 78 into plenum 72 where it is heated and discharged into the ducts 70.

Within bin 10 and above the hot air inlet ducts 70 is another set of exhaust ducts 80. Exhaust ducts 80 are parallel to the previously described exhaust ducts 56 and of similar construction. Exhaust ducts 80 terminate through side walls 12 and 14 and exhaust to the atmosphere.

A final set of hot air inlet ducts 82 are positioned above the exhaust ducts 80. Hot air inlet ducts 82 connect with plenum 86 which is separate from plenum 72 and which includes a separate burner 88. Thus, air from manifold 64 is moved by a fan 90 through opening 92 into plenum 86 for heating by burner 88 and discharge into hot air inlet ducts 82. Ducts 82 are parallel to ducts 70 and of similar construction.

A final set of transverse exhaust ducts 94 are arranged above inlet ducts 82. Ducts 94 also exit to the atmosphere and permit air flow upward to effect preheating of the grain entering the main section of the grain dryer.

The various air flows are as illustrated in FIG. 1. That is, cold air enters the cold air inlet or grill 40 passes through the cold air plenum 33 and manifold 46 into the cold air inlet ducts 52 for countercurrent flow upward through bin 10. This cold air is partially exhausted through ducts 56. The exhaust air is recycled or redirected through manifold 64 and plenums 72 and 86 into hot air inlet ducts 70 and 82.

Air is provided in manifold 64 from exhaust ducts 56 and 68. Supplemental air is provided through an inlet grill 93. This air is mixed. Part of the air passes into the plenum 72 and part of the air passes into plenum 86. Air in plenums 72 and 86 respectively passes into ducts 70 and 82 respectively. This hot air then assumes a generally concurrent flow. Air from inlet ducts 70 exhausts, at least in part, through exhaust duct 68. Air from inlet duct 82 exhausts through duct 80. Part of the air from inlet duct 82 also passes through exhaust ducts 94, thereby serving to preheat a portion of the grain flowing through bin 10. This preheat function is similar to that described in U.S. Pat. No. 3,727,323.

Hot air flow is generally concurrent and cold air flow is generally countercurrent to the flow of grain through the bin 10. Additionally, a portion of the air passing through the bin is recycled therethrough to improve efficiency of operation of the grain dryer. Note that it may be possible to eliminate one of the sets of exhaust ducts such as exhaust ducts 56. Elimination of such ducts would not eliminate the function of recycling of air through the grain dryer. Importantly, the construction of the present invention permits recycling of air in a continuous grain flow type grain dryer to thereby improve the efficiency of operation of the dryer.

While in the foregoing there has been set forth a preferred embodiment of the present invention, it is to be understood that the subject matter of the invention will be limited only by the following claims and their equivalents.

What is claimed is:

1. In a continuous flow grain dryer of the type having an enclosed bin with a wet grain inlet at the top of the bin, grain outlets at the bottom of the bin, means for providing wet grain at the inlet, means for removing grain at the outlets, the improved concurrent counterflow structure for drying said grain comprising, in combination:

a lower set of horizontal cold air inlet ducts extending the length of said bin and joined to means for directing cold air into said cold air inlet ducts;

a first transverse set of horizontal exhaust ducts above the cold air ducts and transverse thereto, said first exhaust ducts connected to a hot air manifold;

a first set of horizontal hot air inlet ducts parallel to the lower set of cold air inlet ducts and positioned above the first exhaust ducts, said first set of hot air ducts also connected to the hot air manifold;

a second set of horizontal exhaust ducts above the first set of hot air inlet ducts and transverse thereto, said second set providing exhaust from the bin to the atmosphere;

a second set of horizontal hot air inlet ducts parallel to the lower cold air inlet ducts and positioned above the second exhaust ducts, said second hot air inlet ducts also connected to the hot air manifold; and means for providing hot air flow to the hot air manifold for subsequent flow into said hot air inlet ducts whereby, air from said first set of exhaust ducts is combined with the hot air inlet flow to said hot air inlet ducts.

2. The improved dryer of claim 1 including a third set of horizontal exhaust ducts positioned between said first transverse set of exhaust ducts and the horizontal cold air inlet ducts, said third set of exhaust ducts also being connected to the hot air inlet manifold.

3. The improved dryer of claim 1 including a set of preheater exhaust ducts positioned above the second set of horizontal hot air inlet ducts and transverse thereto for preheating wet grain to the inlet, said preheat exhaust ducts providing exhaust from the bin to the atmosphere.

4. The improved grain dryer of claim 1 including means for providing outside air to the hot air manifold for combination with air drawn from exhaust ducts.

5. The improved dryer of claim 1 wherein said bin includes opposed end walls and opposed side walls, said inlets being positioned for receipt of fluid medium from one of said end walls, said end wall also including a cold air manifold and a separate hot air manifold attached thereto, said cold air manifold being positioned beneath the hot air manifold and separated therefrom by a baffle wall.

6. The improved dryer of claim 5 wherein said side walls include a separate recycle exhaust manifold, the recycle exhaust manifold being positioned beneath the second set of exhaust ducts, the recycle exhaust manifold being in direct communication with the hot air inlet manifold.

* * * * *